US005543899A

United States Patent [19]

Inami et al.

[11] Patent Number: 5,543,899

[45] Date of Patent: Aug. 6, 1996

[54] CHARGING MEMBER HAVING A FOAMED LAYER OF A MATERIAL WITH SPECIFIED DENSITY AND PORE PROPERTIES, CHARGING DEVICE, PROCESS CARTRIDGE AND IMAGE FORMING APPARATUS FEATURING THE CHARGING MEMBER

[75] Inventors: Satoru Inami, Tokyo; Masaharu Ohkubo, Yokohama; Junichi Kato, Sagamihara, all of Japan

[73] Assignee: Canon Kabushiki Kaisha, Tokyo, Japan

[21] Appl. No.: 233,950

[22] Filed: Apr. 28, 1994

[30] Foreign Application Priority Data

| | | | |
|---|---|---|---|
| Apr. 28, 1993 | [JP] | Japan | 5-128088 |
| Jul. 6, 1993 | [JP] | Japan | 5-192891 |
| Apr. 19, 1994 | [JP] | Japan | 6-080411 |

[51] Int. Cl.[6] ..... G03G 15/02

[52] U.S. Cl. ..... 355/219; 361/225

[58] Field of Search ..... 355/219; 361/225

[56] References Cited

U.S. PATENT DOCUMENTS

| | | | |
|---|---|---|---|
| 4,823,689 | 4/1989 | Kishino et al. | 100/155 R |
| 5,390,007 | 2/1995 | Kugoh et al. | 355/219 |

FOREIGN PATENT DOCUMENTS

| | | | |
|---|---|---|---|
| 0323252 | 7/1989 | European Pat. Off. . | |
| 0504877 | 9/1992 | European Pat. Off. . | |
| 0526235 | 2/1993 | European Pat. Off. . | |
| 00572738 | 8/1993 | United Kingdom | G03G 15/02 |

*Primary Examiner*—Joan H. Pendegrass
*Assistant Examiner*—Quana Grainger
*Attorney, Agent, or Firm*—Fitzpatrick, Cella, Harper & Scinto

[57] ABSTRACT

A charging member for charging a member to be charged includes a foamed layer; a supporting member for supporting the foamed layer, and for being supplied with a voltage; a resistance layer closer to the member to be charged than the foamed layer; wherein the foamed layer has a specific gravity not less than 0.1 (g/cm$^3$) and not more than 0.6 (g/cm$^3$), and wherein an average outer diameter of pores in a cross-section of said foamed layer is not less than 50 microns and not more than 1 mm.

13 Claims, 10 Drawing Sheets

| S. G. \ AVE. O.D. | 30μm | 40μm | 50μm | 100μm | 200μm | 400μm | 700μm | 1 mm |
|---|---|---|---|---|---|---|---|---|
| 0.4g/cm³ | G | G | E | E | E | E | E | E |
| 0.6g/cm³ | G | G | E | E | E | E | E | E |
| 0.8g/cm³ | N | N | N | N | G | G | E | E |

E : VERY QUIET (≦40dB)
G : QUIET (≦50dB)
N : NOISY

FIG. 12

CHARGING MEMBER HAVING A FOAMED LAYER OF A MATERIAL WITH SPECIFIED DENSITY AND PORE PROPERTIES, CHARGING DEVICE, PROCESS CARTRIDGE AND IMAGE FORMING APPARATUS FEATURING THE CHARGING MEMBER

FIELD OF THE INVENTION AND RELATED ART

The present invention relates to a charging member for charging a member to be charged such as a photosensitive member or a dielectric member, to a charging device, to a process cartridge and to an image forming apparatus.

In a conventional contact charging device, a charging member supplied with a voltage is contacted to an image bearing member (photosensitive drum), so as to directly transfer the electric charge to the photosensitive drum to electrically charge the surface thereof to a predetermined potential. As compared with a corona discharging device widely used as a charging device, the contact charging device is advantageous in that the voltage required for providing a predetermined potential of the photosensitive drum surface is low, that amount of ozone production by the charging step is so small that the necessity for an ozone removing filter is eliminated, in that air discharging system construction is simplified, in that the charging device is maintenance free, and in that the structure is simple.

In an image forming apparatus such as an electrophotographic apparatus (copying machine), laser beam printer or electrostatic recording apparatus, the contact charging device is particularly noted and practically used as a means to replace the corona discharging device to charge an image bearing member such as a photosensitive member or dielectric member, or another photosensitive drum.

In the contact charging device or method, an AC biased DC oscillating voltage is applied to the contact charging member to provide uniform potential, and the contact charging member thus supplied with the voltage is contacted to the photosensitive drum.

If the hardness of the charging roller is too large, the charging region between the charging roller and the photosensitive drum is too small with the result that the photosensitive drum is not sufficiently charged.

When the charging member is supplied with the oscillating voltage for the purpose of the uniform charging of the photosensitive drum, the following problem arises. In the case of solid type charging roller, which is high in the hardness, produces charging noise by the charging roller beating the photosensitive drum.

The causes of the charging noise will be described, taking an example of a laser beam printer using the charging roller. The mechanism of the noise production is illustrated in FIG. 14. In FIG. 14, (*a*) is a photosensitive drum, where 1*a* designates a photosensitive layer, 1*b*, a base layer of aluminum electrically grounded. It is rotated at a peripheral speed of 40 mm/sec.

Since a core metal 12*a* of a charging member 12 is supplied with an alternating voltage, positive and negative charges are induced on a charging member 12*b* of carbon dispersed rubber such as EPDM and the base layer 1*b* of the photosensitive drum, respectively, as shown by thick solid line in FIG. 14, (*a*). These charges attract each other, so that the surface of the charging member 12 is attracted to the photosensitive drum to move from the thick solid line position to a thin solid line position. When the alternating electric field starts to change the phase, the positive charge of the charging member 12*b* and the negative charge of the drum base 1*b* are canceled by the opposite polarity charge induced. When the polarity of the alternating electric field is going to change from the positive phase to the negative phase, the positive charge on the charging member 12 and the negative charge on the drum base 1*b* are disappeared. As a result, the surface of the charging member 12*b* returns to the position indicated by a thin solid line in FIG. 14, (*b*). When the alternating electric field reaches to the peak of the negative polarity, the positive and negative charges are induced on the charging member 12*b* side and the drum base 1*b* side, respectively, as shown in FIG. 14, (*c*). Therefore, the charging member 12*b* moves back from the thick solid line position to the thin solid line position. The above-described phenomenon is repeated with the result that the charging member 12 vibrates. This causes the charging noise. When the frequency of the alternating voltage is f, and the frequency of the charging member 12 is F, the charging member 12 vibrates twice in one period of the AC voltage, as will be understood from the foregoing description, and therefore, the following equation results:

$$2f(\mathrm{Hz})=F(c/s).$$

An image forming apparatus is placed in anechoic chamber with a charging member supplied with an AC bias voltage of 2.0 KVpp and 60 Hz, and the charging noise is measured. It was 55 dB. The noise is higher than the corona discharger noise of 50 dB.

Heretofore, the following methods have been considered:

(1) To decrease the frequency of the applied AC component. In this case, the charging noise is reduced to a substantial extent if the frequency is less than 300 Hz. However, in the case of high process speed machine, a cyclic non-uniformity is remarkable, and interference fringes appear.

(2) The peak-to-peak voltage Vpp of the applied AC component is reduced to a value that is not less than twice the charge starting voltage. In this case, the charging noise can be reduced to a substantial extent. However, in this case, it is not possible to uniformly charge the photosensitive drum, but non-uniformity spots appears.

(3) Anti-vibration material may be used in the inside of the photosensitive drum in order to reduce the charging noise. The material may be of rubber or the like. However, this method is disadvantageous in the deformation of the photosensitive drum, in the weight thereof and in the manufacturing cost thereof.

SUMMARY OF THE INVENTION

Accordingly, it is a principal object of the present invention to provide a charging member, a charging device, a process cartridge and an image forming apparatus, capable of satisfactorily charging the member to be charged.

It is another object of the present invention to provide a charging member, a charging device, a process cartridge and an image forming apparatus capable of reducing the charging noise.

It is a further object of the present invention to provide a charging member, a charging device, a process cartridge and an image forming apparatus capable of forming a stabilized charging area between the charging member and the member to be charged.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 12 shows an evaluation of the charging noise reduction in relation to an average outer diameter of pores of the foamed material according to a fifth embodiment of the present invention.

DESCRIPTION OF THE PREFERRED EMBODIMENTS

Referring to the accompanying drawings, the embodiments of the present invention will be described.

Figure 15:
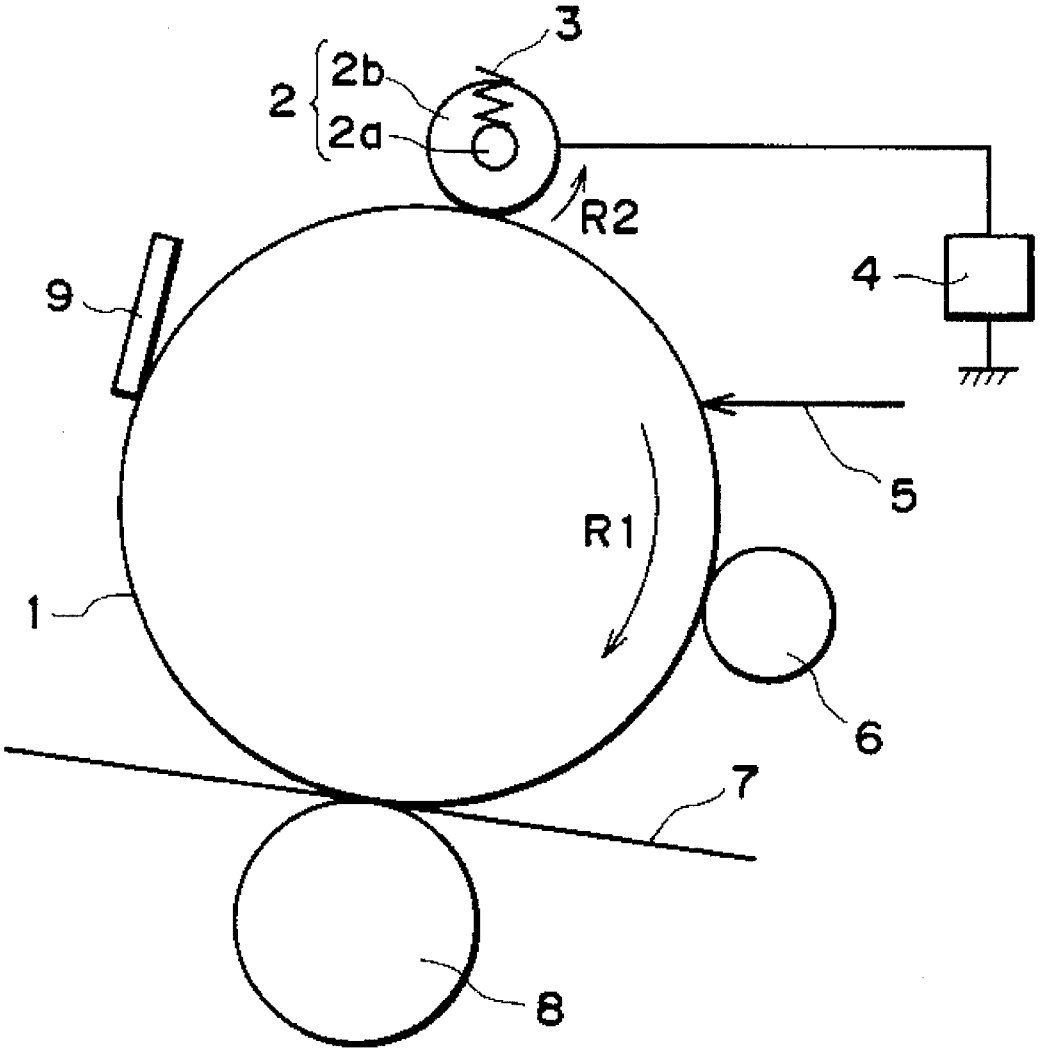
FIG. 15 shows an image forming apparatus using a charging roller.

Referring to FIG. 15, there is shown an image forming apparatus according to an embodiment of the present invention. A photosensitive drum 1 is a drum type image bearing member (electrophotographic photosensitive member or electrostatic recording dielectric member) rotated at a predetermined process speed (peripheral speed) in a clockwise direction indicated by an arrow R1.

The photosensitive drum comprises a photosensitive layer, an electrically grounded base layer of electrically conductive material such as aluminum or the like, for supporting the photosensitive layer. A conductive roller (charging roller) 2 (contact charging member) is press-contacted with a predetermined pressing force to the surface of the photosensitive drum 1 by a spring 3 at each opposite end of the core metal 2*a*. With the rotation of the photosensitive drum 1 (R1 direction), the charging roller 2 is rotated (R2).

Designated by a reference numeral 4 is a voltage source for voltage application to the charging roller 2. By the voltage source 4, the charging roller 2 is supplied with a voltage (Vac+Vdc) which is a DC voltage Vdc biased with an oscillating (alternating) voltage Vac having a peak-to-peak voltage Vpp which is not less than twice as large as the charge starting voltage of the photosensitive drum 1, through a contact leaf spring (not shown) contacted to the core metal 2*a* of the charging roller 2. By doing so, the outer peripheral surface of the photosensitive drum 1 is uniformly charged, while it is rotated. By the application of the oscillating voltage, the voltage level periodically changes with time.

The image forming apparatus comprises a process cartridge C which is detachably mountable to the image forming apparatus. It contains four process means, i.e., an electrophotographic photosensitive member 1 of a rotatable drum type as an image bearing member, a charging roller 2 as a contact charging member, a developing device 6 and a cleaning device 9.

Figure 13:
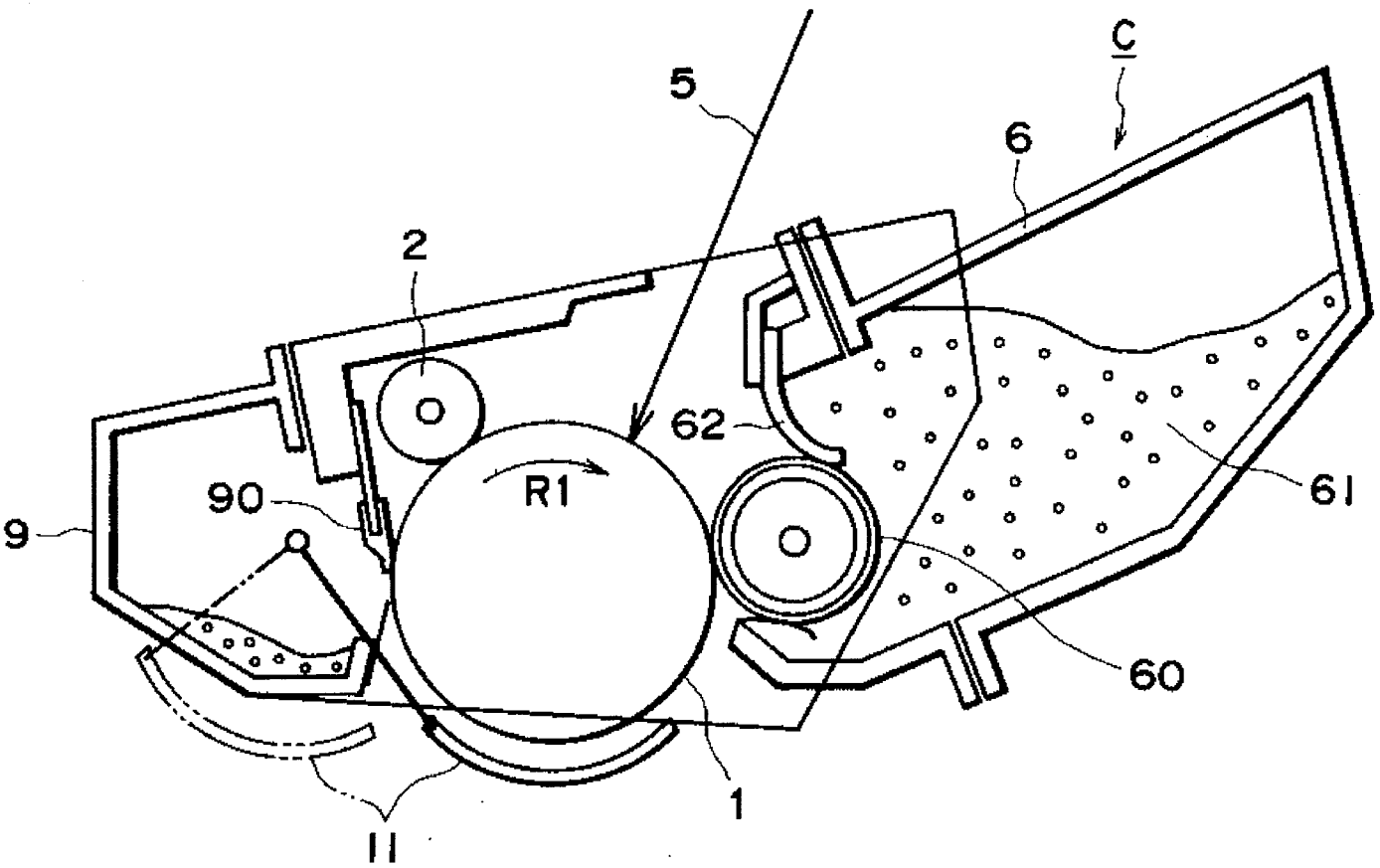
FIG. 13 is a longitudinal section view of a process cartridge according to a sixth embodiment of the present invention.
Figure 14A:
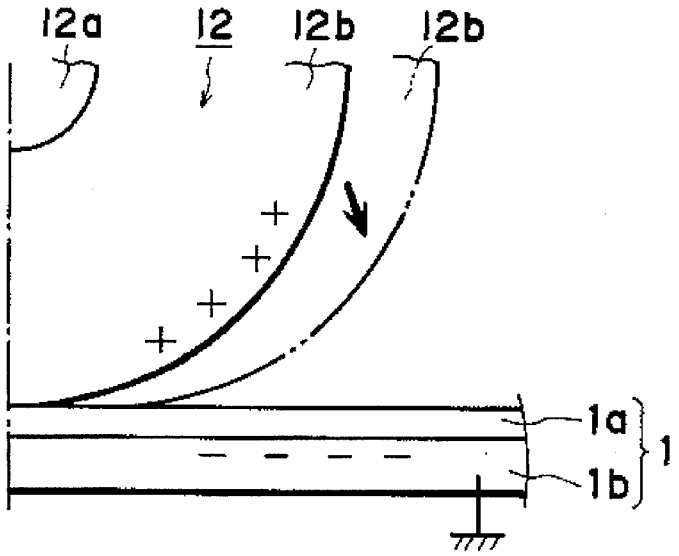
FIGS. 14(*a*), (*b*) and (*c*) illustrate a mechanism of charging noise production.
Figure 14B:
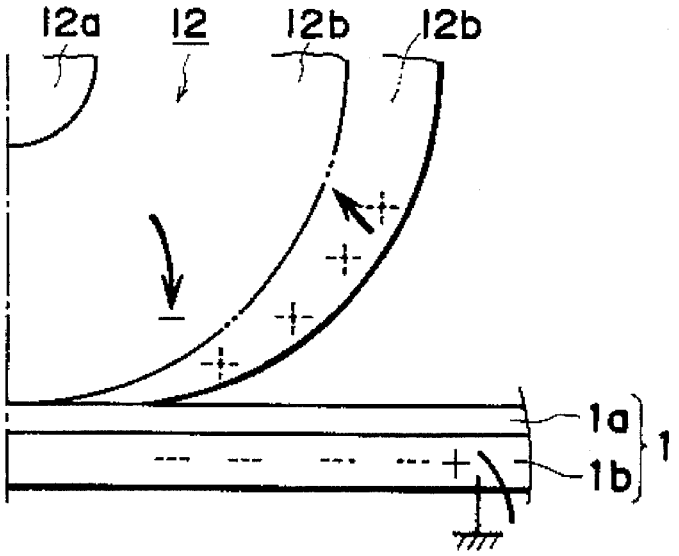
Figure 14C:
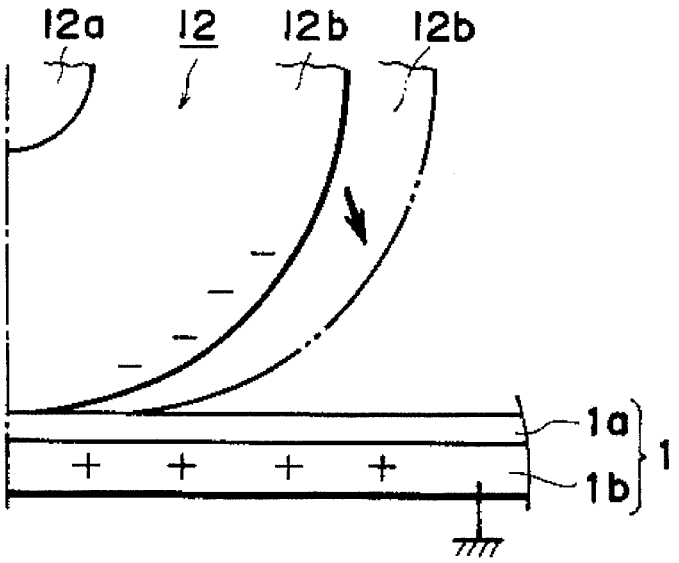

FIG. 13 is a sectional view of the process cartridge C. The process cartridge C may contain at least a photosensitive member 1 and a charging roller 2.

A developing device 6 includes a developing sleeve 60, a developer 61 (toner) a regulating blade for applying a uniform thickness layer of the toner 61 on the developing sleeve 6.

A cleaning device 9 includes a cleaning blade 90.

Designated by a reference numeral 11 is a drum shutter of the process cartridge, and is movable between a closing position indicated by a solid line, and an open position indicated by a broken line. When the process cartridge is out of the image forming apparatus main assembly (not shown), it is in the closing position to protect the surface of the photosensitive drum 1 which is otherwise exposed.

When the process cartridge is mounted into the main assembly of the image forming apparatus, the shutter 11 is opened as indicated by the broken line, or the shutter 11 is automatically opened during the stroke of the mounting operation of the process cartridge. When the process cartridge is mounted in place, the exposed part of the photosensitive drum 1 is press-contacted to the transfer roller 8 of the main assembly of the image forming apparatus.

The main assembly of the image forming apparatus and the process cartridge are mechanically and electrically coupled to permit drive of the photosensitive drum 1 and the developing sleeve 60 and the like in the process cartridge through a driving mechanism of the main assembly, and to permit applications of charging bias voltage to the charging roller 2 of the process cartridge and the developing bias voltage to the developing sleeve 60 and so on, by an electric circuit of the main assembly. Thus, the image forming operation is enabled.

A laser beam 5 is emitted from a laser scanner (not shown) of the main assembly of the image forming apparatus, is introduced into the process cartridge to scan the surface of the rotating photosensitive drum 1 so that an electrostatic latent image is formed on the photosensitive drum. The electrostatic latent image is developed with toner of the developing device 6, and the toner image is transferred onto a transfer material such as sheet of paper by a transfer charger in the form of a transfer roller. The toner image transferred onto the transfer material is fixed by a fixing device (not shown). On the other hand, residual toner remaining on the photosensitive drum 1 after the image transfer operation, is removed by the cleaning device 9.

The description will be made as to the charging device.

Figure 1:
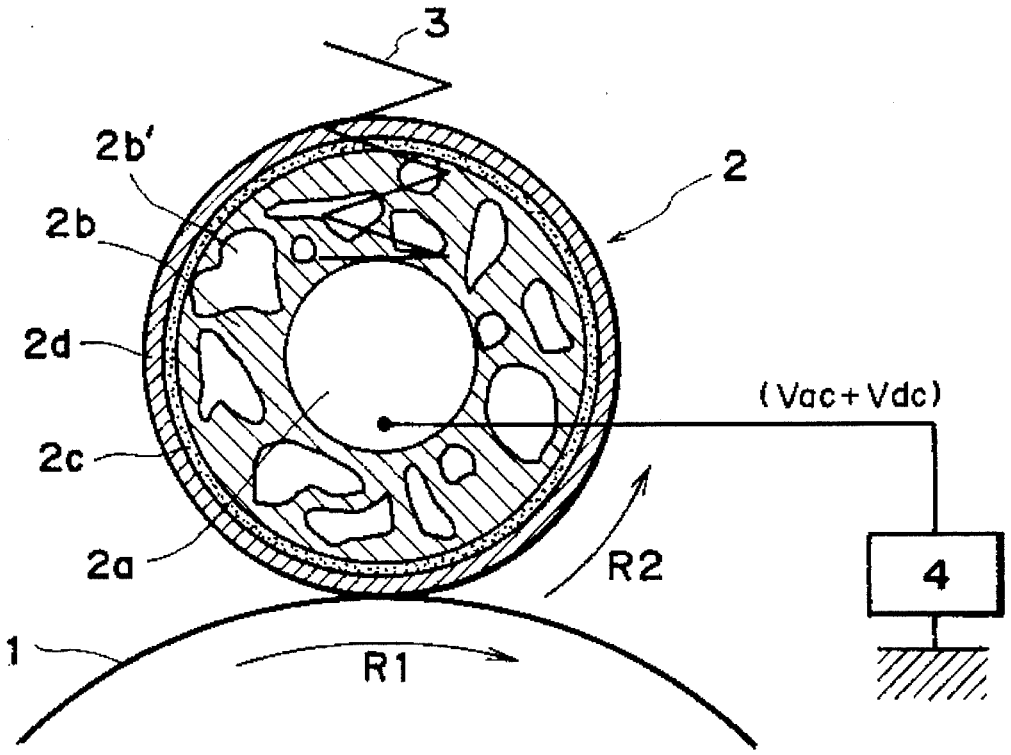
FIG. 1 is a longitudinal sectional view of a charging member according to an embodiment of the present invention.

Prior to describing the embodiment of the charging device, the relationship between the specific gravity of the foamed material (sponge layer) and the charging noise of the charging member, referring to FIG. 1. In the Figure, designated by a reference numeral is an image bearing member (photosensitive drum); 2, charging member; 2*a*, core metal; 2*b*, foamed material; 2*b*', foamed part; 2*c*, conductive layer; 2*d*, an intermediate layer; 3, a pressing spring; and 4, voltage source. FIG. 1 will be described hereinafter.

Examples of materials of the foamed material 2*b* include polystyrene, polyolefin, polyester, polyurethane, polyamide or another foamed material. Such a material may be mixed with carbon, tin oxide or another electroconductive powder to provide the material with the electroconductivity. The main part of the charging member is constituted by the foamed material and the thin intermediate resistance layer. As compared with conventional solid charging member, it is very light, and has a low hardness.

Since the charging member has the small weight and low hardness, the produced charging noise is of practically no problem (not more than 50 dB, for example) since the mass beating the photosensitive drum 1 is light even if the vibration is produced through the mechanism described hereinbefore by the AC component of the applied oscillating voltage.

The inventors have empirically confirmed that the charging noise is influenced more by the specific gravity of the foamed material 2*b* than the hardness thereof, in the charging member having a foamed material 2*b* and an intermediate resistance layer 2*d*.

Figure 3:
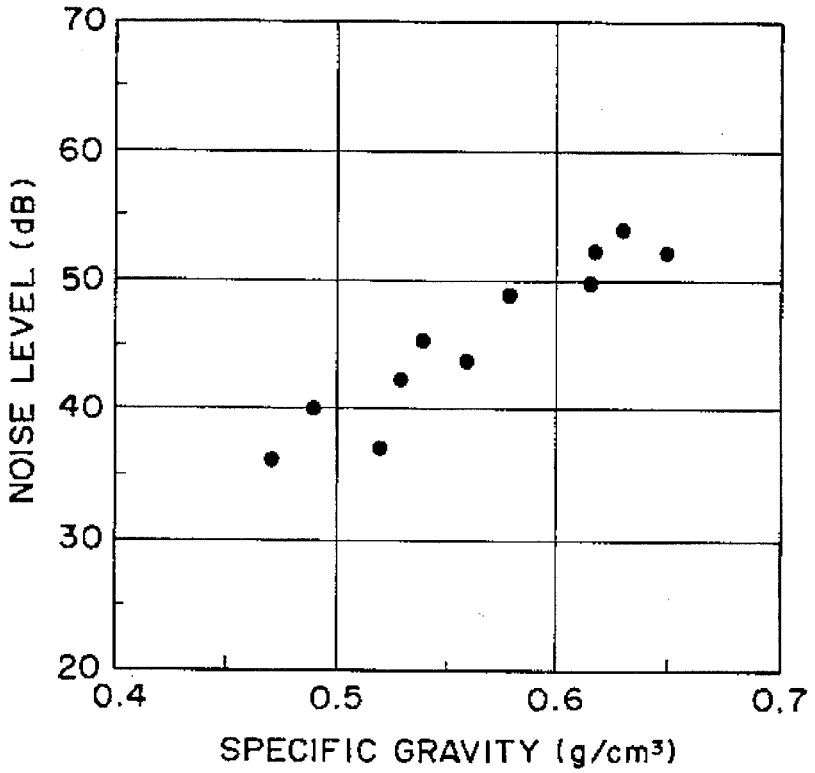
FIG. 3 is a graph showing a noise level relative to a specific gravity of a foamed material, in the charging member.

The specific gravity of the foamed material 2*b* can be reduced by increasing the diameter of the pores 2*b*' by increasing foaming ratio of the foamed material 2*b*, or by increasing the number of pores 2*b*'. As a result, the energy of vibration of the charging member 2 can be reduced, thus reducing the produced charging nose level. FIG. 3 is a graph of the noise level relative to the specific gravity of the foamed material 2*b*. The hardness of the charging member 2 is approx. 45 degrees (Asker-C). From the graph of FIG. 3, it will be understood that the specific gravity of the foamed material 2*b* is preferably 0.6 g/cm$^3$ for the purpose of suppressing the noise to the non-uncomfortable level (not more than 50 dB). On the other hand, the low specific gravity means large volume of pores per unit volume of the foamed material 2*b*. The vibration energy resulting from the beating between the charging member 2 and the photosensitive drum 1 which is a cause of the charging noise, is dispersed by the pores 2*b*', and therefore is reduced. In other words, if the volume of the pores 2*b*' is large, the vibration energy is absorbed and reduced, thus suppressing the production of the charging noise.

Figure 4:
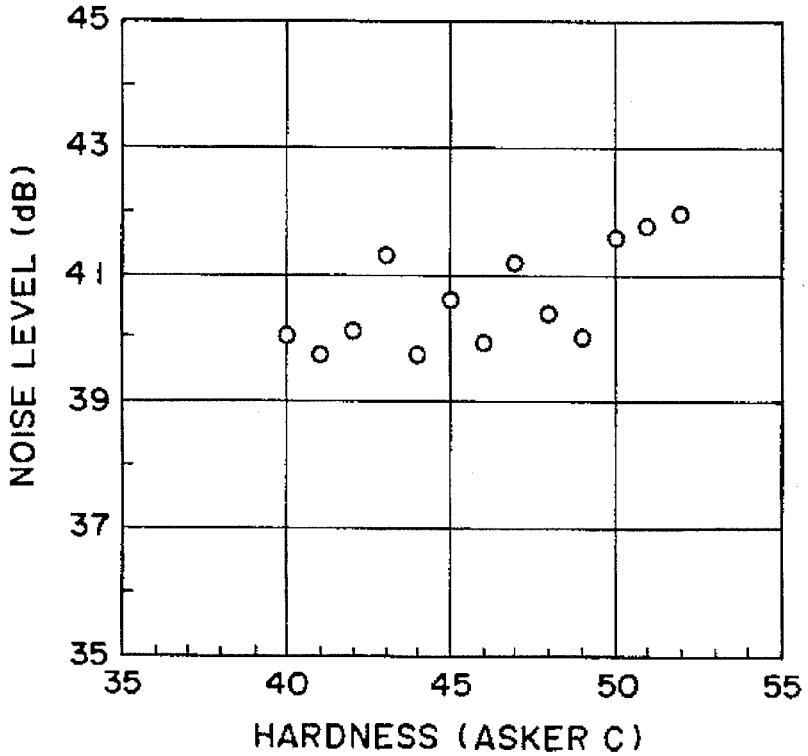
FIG. 4 is a graph of a noise level relative to a hardness of the foamed material, in the charging member.

FIG. 4 is a graph of noise level relative to the hardness when the specific gravity of the charging member 2 is 0.5 g/cm$^3$. As will be understood from the graph, the level of the charging noise does not change even if the hardness changes by 7 degrees approximately, if the specific gravity is not more than 0.6 g/cm$^3$. Therefore, the charging noise is more influenced by the specific gravity. This means that the latitude of the hardness of the charging member 2 is large in the manufacturing.

When the specific gravity of the charging member 2 is quite low, the charging member is easily worn or deformed by the contact with the photosensitive drum 1. If this occurs, the defect in the nip results in improper charging. In order to prevent his, it is required that the specific gravity of the charging member 2 is not less than 0.1 g/cm$^3$.

The description will be made as to the measurement of the specific gravity. There are independent and continuous pores in the pores 2*b*' of the foamed material 2*b*. When the volume is to be determined in the case of the continuous pores, water enters the pores when it is in water, and therefore, correct volume can not be determined. Therefore, when the volume is to be determined, the foamed material 2*b* is covered with a film of several tens microns of very low weight. The volume of the film can be neglected. Then, the material is placed in water, to determine the volume w (cm$^3$) is determined. The temperature of the water is 4° C. The specific gravity is m/w, where m (g) is a mass of the foamed material 2*b*.

The intermediate layer 2*d* is backed up by the foamed material 2*b*, and therefore, the shape thereof is maintained in good order although the thickness is small, and therefore, it is not apart from the surface of the photosensitive drum 1 even if the charging member is deformed upon being press-contacted to the surface of the photosensitive drum 1. Thus, it is closely press-contacted to the surface of the photosensitive drum 1 over the entire length. Accordingly, no improper charging occurs even if the length of the charging member 2 is increased.

The fact that the charging noise can be reduced means that the frequency of the AC component of the applied oscillating voltage to the charging member 2 can be increased. Thus, a moire condition which is a problem in the case of low frequency and which appears on the image by the interference due to the AC component frequency and the scanning laser beam, can be avoided.

In the image forming apparatus provided with the charging member 2 described in the foregoing, the beating force of the charging member 2 to the photosensitive drum 1 is reduced, and therefore, toner fusing resulting from the toner not removed by the cleaning being pressed against the photosensitive drum 1, can be avoided.

Figure 2:
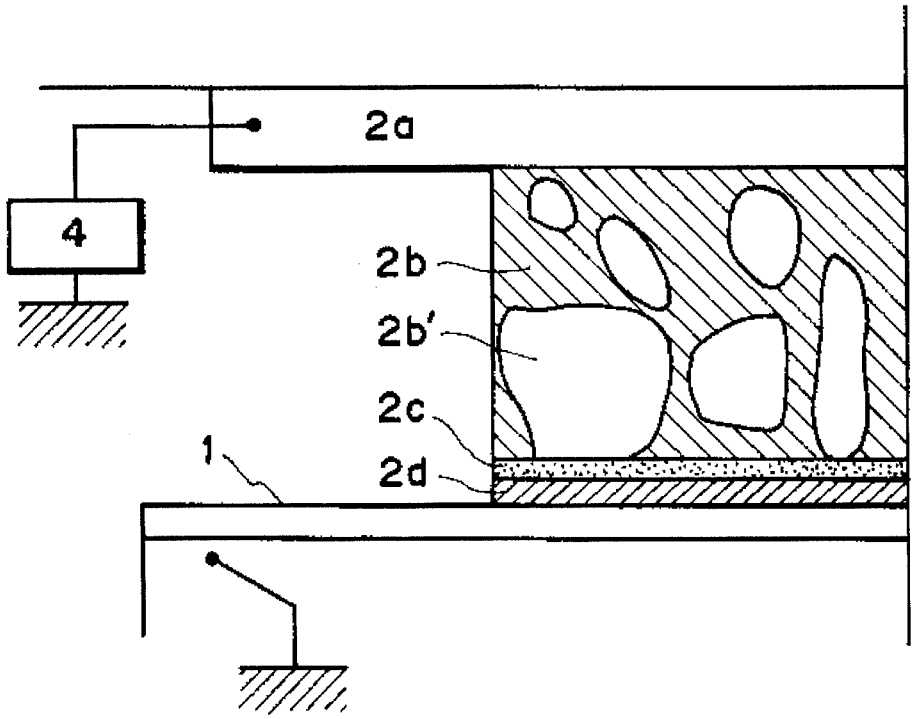
FIG. 2 is a sectional view of the charging member adjacent to an end thereof.

Referring to FIG. 1, there is shown a contact charging device or member according to an embodiment of the present invention. FIG. 2 is a sectional view adjacent an end.

Designated by a reference numeral 1 is a member to be charged (image bearing member) in the form of a photosensitive drum chargeable to a negative or positive voltage. A charging roller 2 (contact charging member) comprises a core metal 2*a* of stainless steel as a supporting member, a foamed layer 2*b* (sponge) coaxial with the core metal 2*a* and on the outer peripheral surface thereof, an electroconductive layer 1*c* on the outer surface of the foamed material layer 2*b*, and an intermediate layer 2*d* covering the outer periphery thereof (four-layer structure). The volume resistivity of the intermediate resistance layer 2*d* is larger than that of the electroconductive layer 2*c*.

The foamed material 2*b* of polystyrene, polyolefin, polyester, polyurethane, polyamide or another foamed material, or foamed EPDM or urethane material, in which electroconductive powder such as carbon or tin oxide is dispersed, by which the volume resistivity is reduced. The foamed material 2*b* has a specific gravity of not less than 0.1 g/cm$^3$ and not more than 0.5 g/cm$^3$. In this embodiment, the carbon is dispersed in the foamed polyurethane material. Designated by 2*b*' are pores (filled with air, nitrogen, argon or another gas). The foamed material includes independent pores, and has a specific gravity of 0.5 g/cm$^3$ determined through the above-described process.

The specifications of the charging roller are:

Core metal 2a:

6 mm in diameter, 260 mm in length, stainless steel rod.

Foamed material 2b: carbon dispersed foamed polyurethane 0.5 g/cm$^3$ in the specific gravity, $10^2\Omega$.cm–$10^9\Omega$.cm in the volume resistivity, 2.8 mm thick, 230 mm long Conductive layer 2c: EPDM or urethane material in which a great amount of carbon, tin oxide or another conductive power is dispersed $10^2\Omega$.cm–$10^5\Omega$.cm in the volume resistivity (layer thickness of 80 μm)

Intermediate resistance layer 2d: epychlorohydrin rubber volume resistivity of $10^7\Omega$.cm–$10^{10}\Omega$.cm, layer thickness t of 80 μm Weight of the charging roller 2:

68 g, hardness: 35 degrees (ASKER-C)

The charging roller, similarly to the charging roller 2 of FIG. 12 described in the foregoing is supported by unshown bearing members at the opposite ends of the core metal 2a, and is urged to the photosensitive drum by a pressure spring 3 to press-contact to the photosensitive drum surface with a predetermined pressure, 1000 g in total pressure in this embodiment. With the rotation of the photosensitive drum 1 (R1), the charging roller is rotated (R2). The following voltage is applied to the charging roller 2 from the voltage source 4 through a sliding electrode (not shown) contacted to the core metal 2a of the charging roller:

AC voltage: 2.0 KVpp, 600 Hz in this embodiment

DC voltage: corresponding to a target charge potential

They are superposed (Vac+Vdc). By doing so, the peripheral surface of the rotating photosensitive drum 1 is uniformly charged by an AC type process to the target potential. The oscillating voltage can be produced by repeating on and off of a DC voltage source (rectangular wave). For the purpose of preventing the non-uniformity in the charging, it is preferably not less than twice the charge starting voltage of the photosensitive drum 1.

(1) The charging noise is measured in the case of the charging roller of this embodiment and the conventional solid charging roller. The specifications of the conventional solid charging roller, are:

Core metal 2a:

6 mm in diameter, 260 mm in length stainless steel rod

Intermediate layer 2b: EPDM (terpolymer of ethylene propylenediene) which is solid an din which carbon is dispersed Specific gravity: 0.95 g/cm$^3$ Volume resistivity of $10^5\Omega$.cm Layer thickness, 2.8 mm and length thereof, 230 mm Weight: 230 g Hardness 62 degrees (ASKER C).

Since the mass beating the photosensitive drum 1 is small the produced charged noise is reduced to the practically non-problem level, even if the vibration occurs through the mechanism described in the foregoing, due to the AC component of the applied oscillating voltage.

The contact charging device of this embodiment is placed in anechoic chamber, and the produced noise (charging noise) is measured in the above-described oscillating voltage application. The measurement is carried out in accordance with ISO 7779, paragraph 6. As a result, the produced charging noise of the conventional solid charging roller is 55 dB, and that of the charging roller of this embodiment is as low as 40 dB.

(2) The intermediate layer 2d is backed up by the conductive layer 2c and the foamed material 2b, and therefore, the shape thereof is maintained in good order although the thickness is small, and therefore, it is not apart from the surface of the photosensitive drum 1 even if the charging member is deformed upon being press-contacted to the surface of the photosensitive drum 1. Thus, it is closely press-contacted to the surface of the photosensitive drum 1 over the entire length. Accordingly, no improper charging occurs even if the length of the charging member 2 is increased.

(3) The fact that the charging noise can be reduced means that the frequency of the AC component of the applied oscillating voltage to the charging member 2 can be increased. Thus, a moire condition which is a problem in the case of low frequency and which appears on the image by the interference due to the AC component frequency and the scanning laser beam, can be avoided. In order to prevent the moire condition, the frequency of the oscillating voltage is higher than 300 Hz.

(4) Since the drum beating force of the charging roller is reduced, the toner fusing resulting from the remaining toner being pressed against the surface of the photosensitive drum 1, can be avoided.

The reduction of the charging noise is provided even if the pores are independent or continuous.

[Embodiment 2]

The charging roller 2 of this embodiment is a modification by forming an intermediate resistance layer 2c through an electroconductive layer 2c on the conductive foamed layer 2b and by providing a protection layer 2e on the outer surface thereof.

Figure 5:
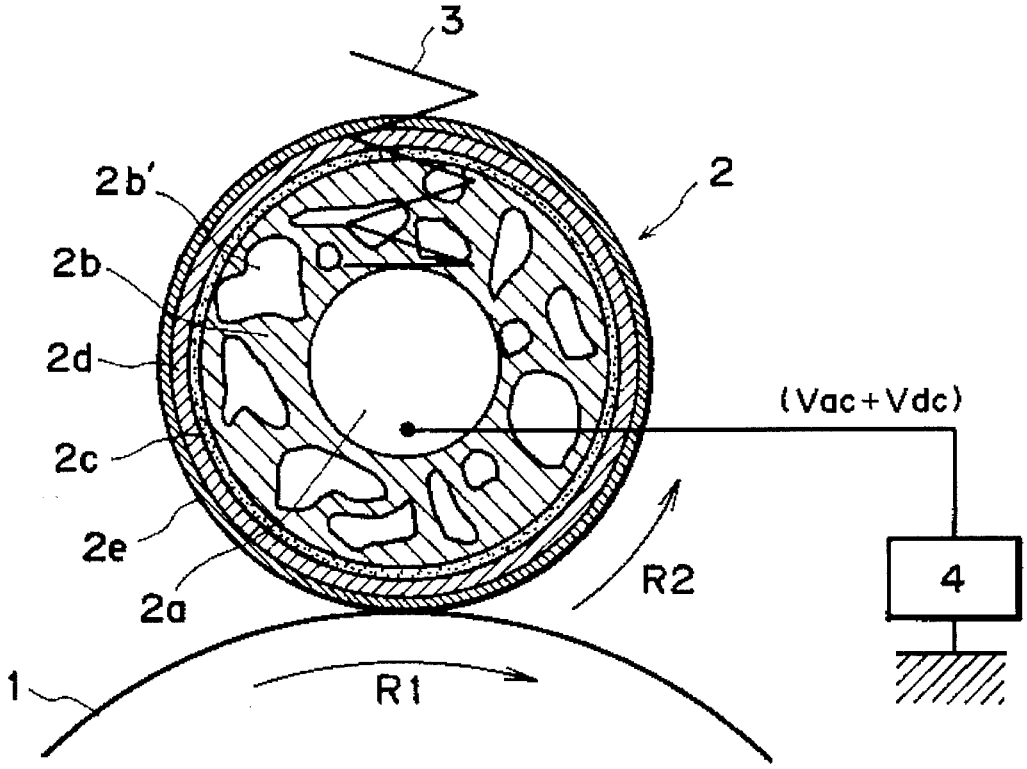
FIG. 5 is a longitudinal sectional view of a charging member according to a second embodiment of the present invention.
Figure 6:
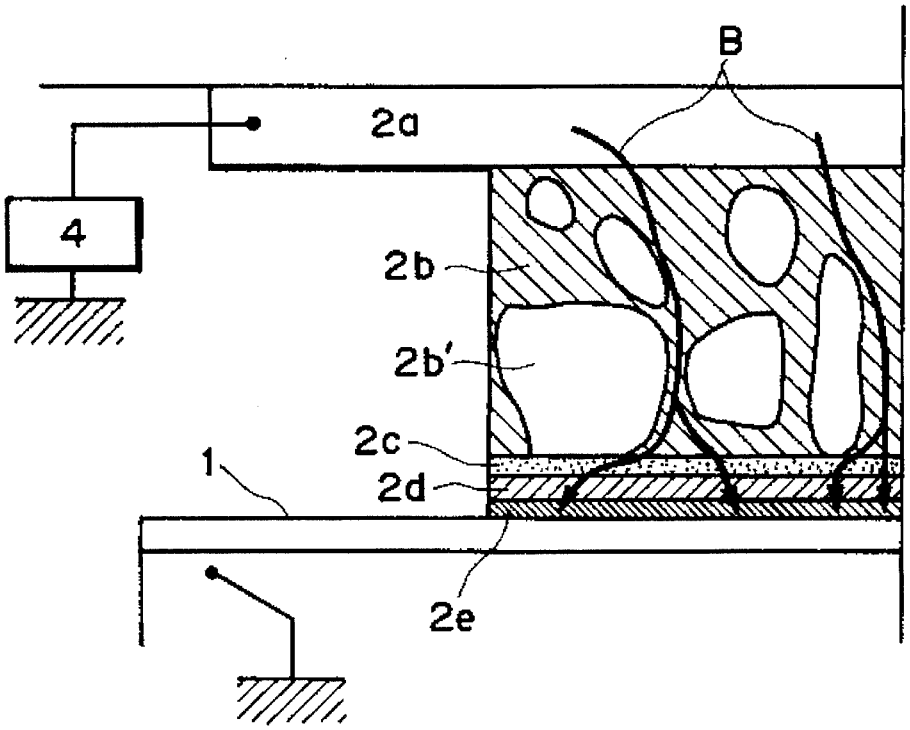
FIG. 6 is a sectional view of an end portion of the charging member.

FIG. 5 is a longitudinal sectional view of the charging member, and FIG. 6 is a sectional view adjacent an end thereof.

The specifications of the charging roller 2 are as follows:

Foamed material 2b: foamed epychlorohydrin rubber in which carbon is dispersed Specific gravity of 0.5 g/cm$^3$ Volume resistivity of $10^3\Omega$.cm–$10^9\Omega$.cm Layer thickness of 2.8 mm, and a length of 230 mm.

On the core metal side, vibration absorbing layer having a higher foaming ratio can be provided.

Electroconductive layer 2c: EPDM or urethane material in which a large amount of conductive powder such as carbon, tin oxide or the like is dispersed.

Volume resistivity of $10^2\Omega$.cm–$10^5\Omega$.cm

Layer thickness of 10 mm

Intermediate resistance layer 2d: epychlorohydrin rubber

Volume resistivity of $10^7\Omega$/cm–$10^{10}\Omega$.cm.

Layer thickness of 200 μm

Protection layer 2e: N-methoxymethyl nylon

Volume resistivity of $10^7\Omega$.cm–$10^{12}\Omega$.cm

Layer thickness of 5 μm

Weight of the charging roller 2:

68 g, hardness: 35 degree (ASKER-C)

Pressure between drum 1: total pressure of 1000 g

Applied voltage:

AC component Vac: 200 KVpp, 600 Hz

DC component Vdc: DC voltage corresponding to the target charge potential.

The measured noise of the charging roller 2 is 40 dB (ISO 7779-6).

The protection layer 2e on the outer surface of the intermediate resistance layer 2e may be of a material having good affinity with the surface of the photosensitive drum 1, by which the contamination of the photosensitive drum 1 and the surface layer of the charging roller 2 can be avoided. In addition, it is not possible to supply the electric charge into the intermediate resistance layer with which large size pores of the conductive foamed material 2b are contacted, the improper charging occurs in the intermediate resistance layer. However, by the conductive layer 2c interposed between the electroconductive foamed material 2b and the intermediate resistance layer 2d, the electric charge can easily enter the intermediate resistance layer (B, in the Figure), and therefore, the charge amount of the intermediate resistance layer 2d is uniformized. Even if the pores 2b' are large with higher foaming ratio, the improper charging does not occur as a result of the large pores.

[Embodiment 3]

The electroconductive foamed material 2b is coated with tube 2f, so that an intermediate resistance layer 2d is formed through a conductive layer 2c on the tube 2f, and a protection layer 2e is foamed on the outer surface thereof.

Figure 7:
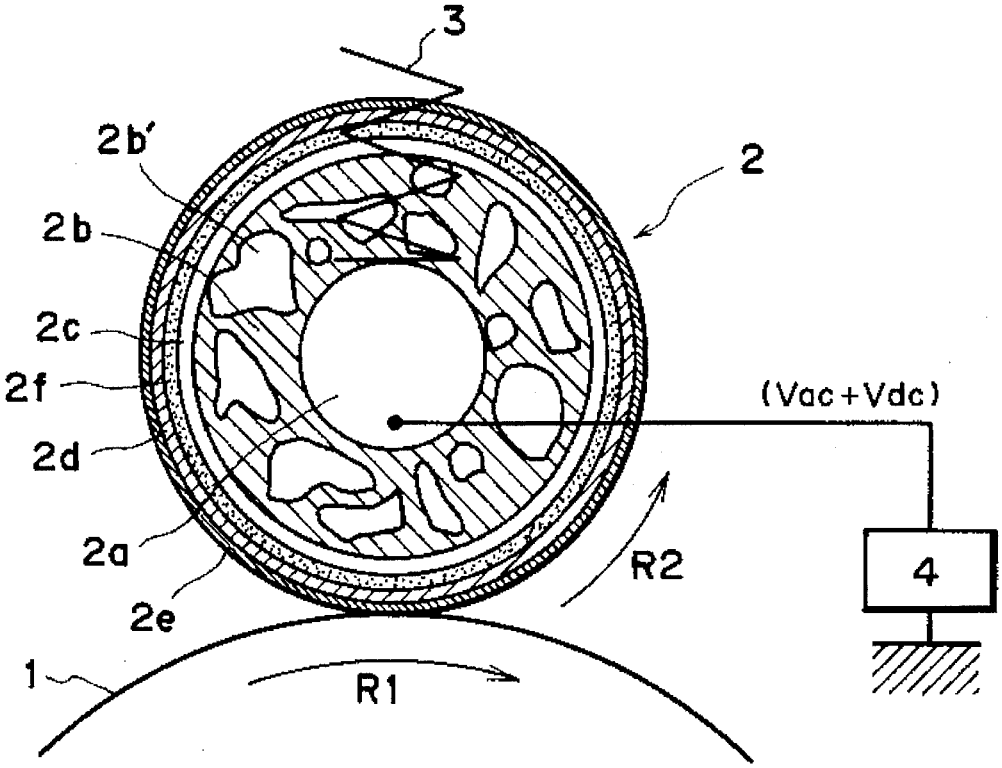
FIG. 7 is a longitudinal sectional view of a charging member according to a third embodiment of the present invention.
Figure 8:
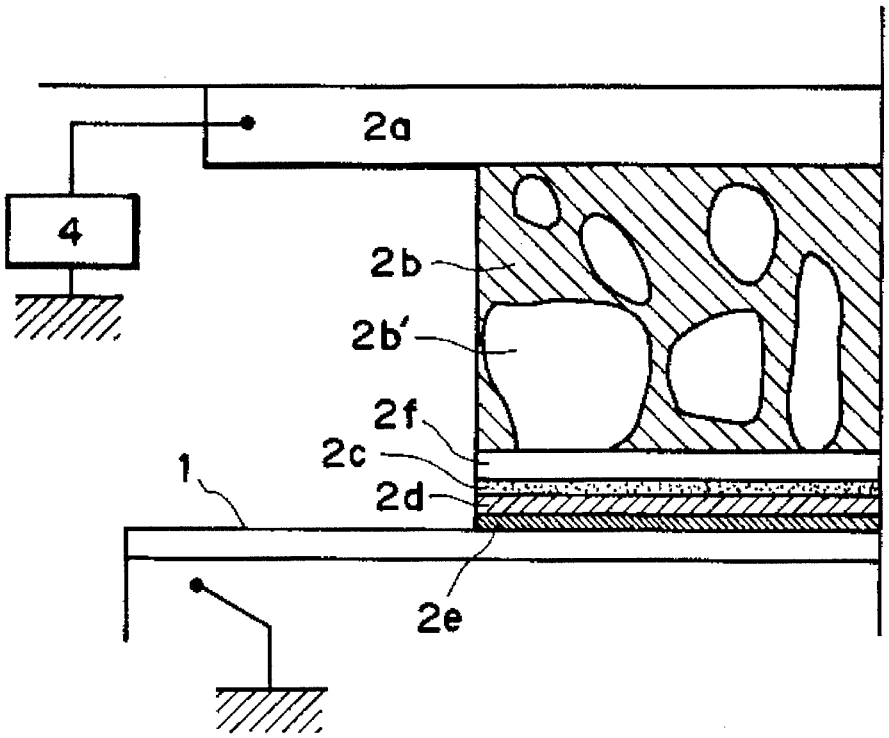
FIG. 8 is a sectional view of the charging member adjacent its end.
Figure 9:
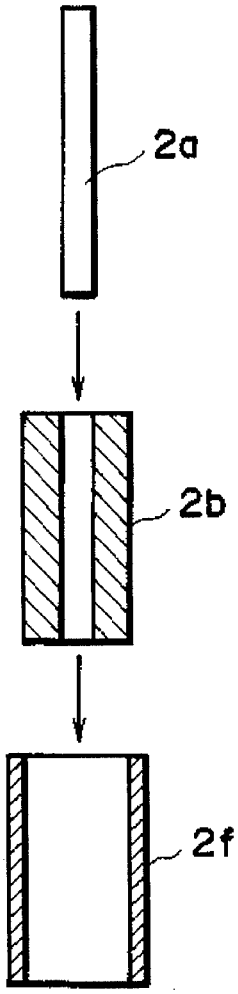
FIG. 9 shows a manufacturing method of the charging roller.

FIG. 7 is a longitudinal sectional view of the charging member of this embodiment. FIG. 8 is a sectional view adjacent an end thereof.

The specifications are as follows:

Foamed material 2b: foamed epychlorohydrin rubber in which carbon is dispersed Specific gravity of 0.4 g/cm$^3$ Volume resistivity of $10^2$–$10^6$Ω.cm Layer thickness of 2.6 mm and a length of 230 mm Tube 2f: thermo-curing polyurethane elastomer Volume resistivity of $10^3$–$10^9$Ω.cm Layer thickness of 250 μm Electroconductive layer 2c: EPDM or urethane material in which a great amount of electroconductive power of carbon or tin oxide or the like is dispersed.

Volume resistivity of $10^1$–$10^6$Ω.cm

Layer thickness of 10 μm

Intermediate layer 2d: epychlorohydrin rubber

Volume resistivity of $10^8$–$10^{10}$Ω.cm

Layer thickness of 180 μm

Protection layer 2e: N-methoxymethyl nylon

Volume resistivity of $10^7$–$10^{12}$Ω.cm

Layer thickness of 5 μm

Weight of the charging roller 2:

70 g, hardness: 45 degrees (ASKER-C)

Pressure to the photosensitive drum 1:

1000 g in total

Applied oscillating voltage:

AC component Vac: 2.0 KVpp, 600 Hz

DC component Vdc: DC voltage corresponding to the target charge potential.

Figure 10:
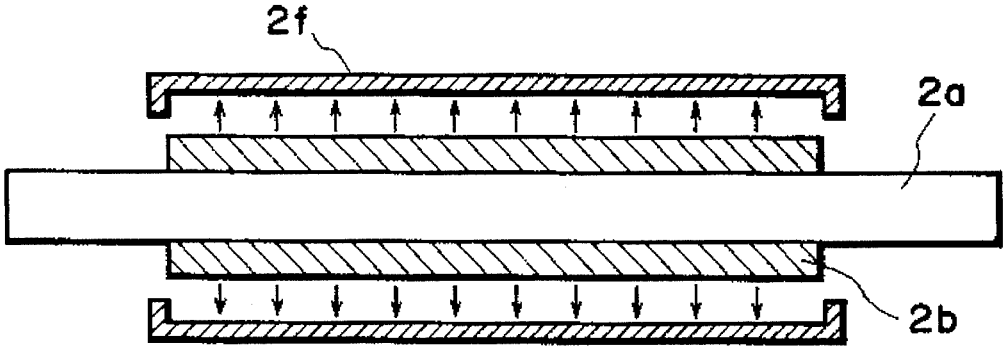
FIG. 10 shows a manufacturing method of the charging roller.

This structure may be produced in the following manner. Foamed material 2b is produced from foamed epychlorohydrin rubber, first. Then, the core metal 2a is inserted and tube 2f is telescoped (FIG. 7). As an alternative, the core 2a is erected in the tube 2f, and the epychlorohydrin rubber (foamed material 2b) is inserted, and the foaming operation is effected with the fixed state (FIG. 10). In the former method, deviation or twisting occurs during the intersection, and therefore, it is difficult to produce stabilized images, and therefore, the charging roller is produced through the latter method in this embodiment.

The tube 2f covering the conductive foamed material 2b is substantially separated from the electroconductive foamed material 2b. The same applies to the core metal 2a and the electroconductive foamed material 2b. Further in order to prevent the deviation in the axial direction, the tube 2f and the conductive foamed material 2b, and the core metal 2a and a part of the conductive foamed material 2b may be fixed. As a result, even if an AC voltage is applied to the core metal 2a, the heavy core metal 2a does not vibrate, and only the light electroconductive foamed member 2b and the tube 2f vibrate to beat the photosensitive drum 1. The energy thereof is small, and therefore, the charging noise is small. The produced charging noise of the charging roller 2 in this case is 35 dB (ISO 7779-6) which is smaller than the case without the tube (Embodiment 2).

In the case of the conductive foamed member 2b, pits and projections are easily produced on the surface thereof. The provision of the tube 2f having better surface property is effective to prevent improper charging on the image.

The tube is relatively hard as compared with the conductive foamed member, and therefore, deformation due to external force can be prevented.

[Embodiment 4]

Figure 11:
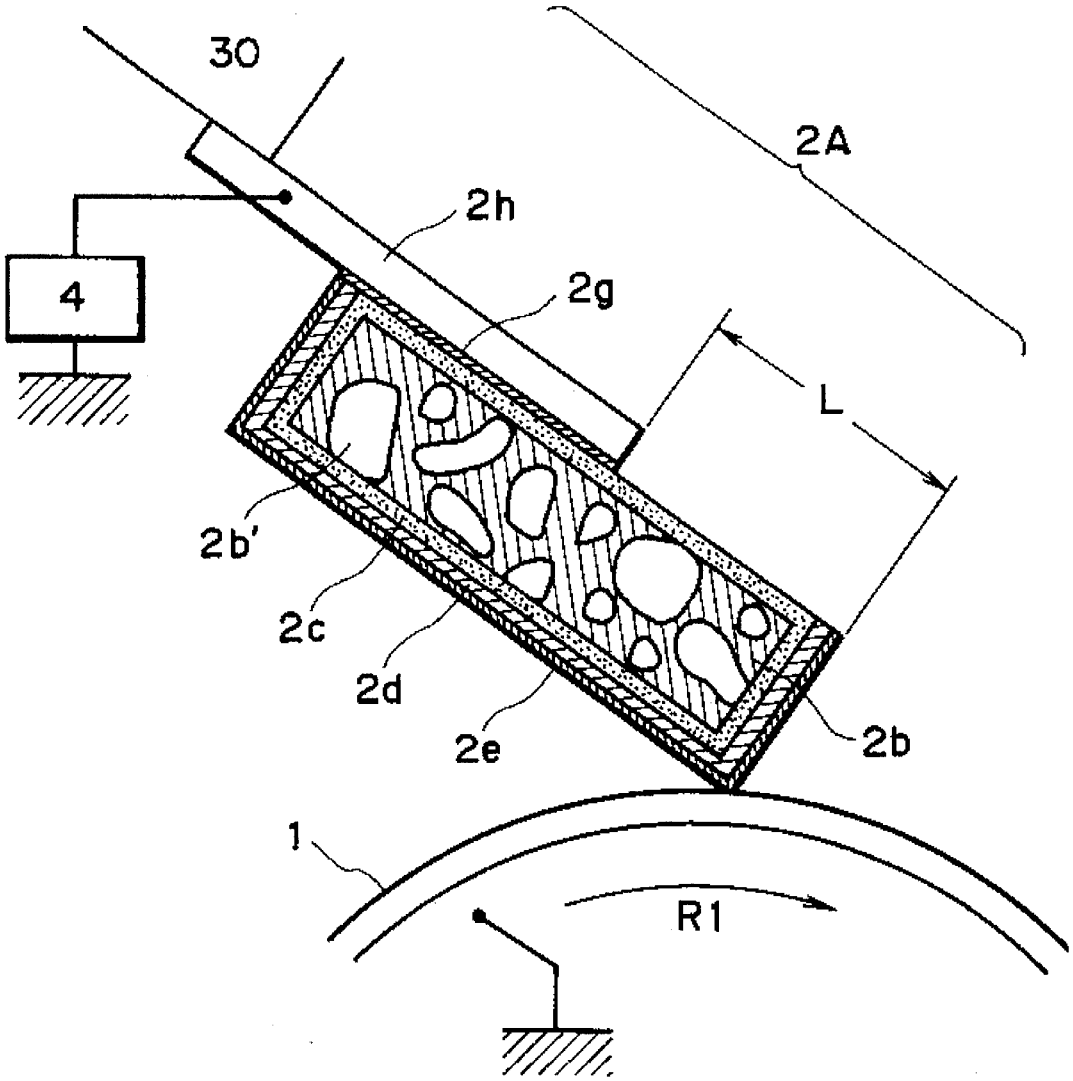
FIG. 11 is a longitudinal sectional view of a charging member (charging blade) according to a fourth embodiment of the present invention.

In this embodiment, the contact charging member is in the form of a blade (charging blade). FIG. 11 is a sectional view of the charging blade 2A, or a contact charging device. The contact charging device using the charging blade 2A has a simpler structure than the charging roller.

The charging blade 2A, in this embodiment, comprises carbon dispersed foamed polyurethane foamed member (core metal) 2b having a specific gravity not less than 0.1 g/cm$^3$ and not more than 0.6 g/cm$^3$, electroconductive layer 2c, thereon, of EPDM or urethane material in which a great amount of conductive powder such as carbon or tin oxide or the like is dispersed, an intermediate resistance layer 2d of epychlorohydrin rubber thereon, and a protection layer 2e. They are bonded by electroconductive bonding material 2g on the electrode plate 2h as a supporting member.

An edge of the charging blade 2A is press-contacted with proper pressure on the surface of the photosensitive drum 1 using the rigidity of the blade. With this state maintained, the electrode plate 2h is fixed on a fixed member 30. In this manner, the charging blade 2 is mounted.

The charging blade 2A is supplied with an oscillating voltage (Vac+Vdc) through a supporting member 2f as the electrode plate, from a voltage source 4, by which the rotating photosensitive drum 1 surface is contact-charged uniformly through the AC charging process.

The specifications of this embodiment are as follows.

Foamed member 2b: formed polypropylene in which conductive powder is dispersed Specific gravity of 0.55 g/cm$^3$ Volume resistivity of $10^2$–$10^8$Ω.cm Width of 10 mm, length of 260 mm and thickness of 3 mm Conductive layer 2c: EPDM or urethane material in which a large amount of carbon or tin oxide or another electroconductive powder is dispersed Volume resistivity of $10^2$–$10^5\Omega$.cm Layer thickness of 80 μm Intermediate resistance layer 2*d*: epychlorohydrin rubber Volume resistivity of $10^7$–$10^9\Omega$.cm Layer thickness of 100 μm Protection layer 2*d*: N-methoxymethyl nylon Volume resistivity of $10^7$–$10^{12}\Omega$.cm Layer thickness of 30 μm Hardness of the charging blade 2A: 45 degrees (ASKER-C)

Free length L of the charging blade 2A: 5 mm

Total pressure to the photosensitive drum: 700 g

The produced charging noise of the charging blade 2*a* is 44 dB (ISO 7779-6). Therefore, with the charging blade 2A, the charging noise can be reduced by selecting the specific gravity of the foamed member to be not less than 0.1 g/cm$^3$ and not more than 0.6 g/cm$^3$. The charging blade 2A has an advantage that the pressure to the photosensitive drum 1 can be controlled using the rigidity of the blade, and therefore the pressure spring as in the case of the charging roller is not necessitated, so that the structure can be simplified, and the cost can be reduced.

Using the charging roller 2 of embodiment 1, the relation between the outer diameter of the pores 2*b*' and the charging noise will be described.

FIG. 12 shows the level of the charging noise relative to the average outer diameter of the pores 2*b*' of the foamed material when the specific gravity is 0.4, 0.6 or 0.8 g/cm$^3$. In this table, "E" means very quiet (not higher than 40 dB); "G" means quiet (not higher than 50 dB); "N" means uncomfortable level (not less than 51 dB). For all specific gravities, the amount of the foaming material, the time period of the foaming of the material or the like are changed to change the outer diameter of the pores 2*b*' with the constant specific gravity.

The description will be made as to the measurement of the outer diameter of the pores. A cross-section of the foamed material is observed through an optical microscope, and the outer diameters of the pores are measured at about 50 positions, and the average is obtained. The optical microscope is OPTIPHOT, available from Nikon Kabushiki Kaisha, Japan, and the outer diameter is measured using LUZEX3, available from Nireco.

in FIG. 12, as described with Embodiment 1, when the specific gravity is 0.4 and 0.5 g/cm$^3$ (within the range of 0.1–0.6 g/cm$^3$), the charging noise is low not more than 50 dB, irrespective of the outer diameter of the pores 2*b*'. On the contrary, when the specific gravity is 0.8 g/cm$^3$, the charging noise is low enough if the average outer diameter of the pores 2*b*' is not less than 200 μm.

In the case of 0.4 and 0.6 g/cm$^3$, when the average outer diameter of the pores 2*b*' is not less than 50 μm, the charging noise is very low (not higher than 40 dB). This has been confirmed. In other words, within the range of the specific gravity between 0.1–0.6 g/cm$^3$ of the charging member 2*b*, the reduction of the charging noise is expected when the outer diameter of the pores 2*b*' is not less than 50 μm.

When the outer diameter of the pores 2*b*' is quite large, that is, the cavities are large, it is not possible to maintain the original shape of the charging roller 2 at the contact portion between the roller 2 and the photosensitive drum 1 (deformation). If the deformation is not immediately removed, improper charging will occur. Therefore, from the standpoint of suppressing the deformation of the charging roller 2 and from the standpoint of preventing production of improper image, the average outer diameter of the pores 2*b*' is preferably not more than 1 mm.

As described in the foregoing, if the specific gravity of the foamed material 2*b* is 0.1–0.6 g/cm$^3$, the charging noise is practically low enough irrespective of average outer diameter of the pores 2*b*'. Further preferably, the average outer diameter of the pores 2*b*' is 50 μm–1 mm, since the charging noise can be further reduced.

As shown in FIG. 13, the process cartridge including the charging member is detachably mountable to the main assembly of the printer. In this case, the vibration produced by the beating between the charging roller and the photosensitive drum is easily transmitted to the entirety of the process cartridge with the result of amplified charging noise.

However, when the charging roller of this invention is used, by which the charging noise is hardly produced even if an oscillating voltage (AC+DC) is applied to the charging roller. Therefore, very compact process cartridge substantially free of the charging noise can be provided.

In the foregoing embodiments, when the average wall thickness between the pores of the foamed material is small, the charging member can be easily deformed at the contact portion with the drum. If this occurs, improper charging results. In order to prevent this, the average wall thickness between the pores is preferably not less than 1 mm.

While the invention has been described with reference to the structures disclosed herein, it is not confined to the details set forth and this application is intended to cover such modifications or changes as may come within the purposes of the improvements or the scope of the following claims.

What is claimed is:

1. A charging member for charging a member to be charged comprising:

a foamed layer;

supporting member, for supporting said foamed layer, and for being supplied with an oscillating voltage;

a resistance layer closer to the member to be charged than said foamed layer;

wherein said foamed layer has a specific gravity not less than 0.1 (g/cm$^3$) and not more than 0.6 (g/cm$^3$), and wherein an average outer diameter of pores in a cross-section of said foamed layer is not less than 50 microns and not more than 1 mm.

2. A charging member according to claim 1, wherein said charging member comprises an electroconductive layer between said foamed layer and said resistance layer.

3. A charging member according to claim 1, wherein said charging member is contactable to the member to be charged to electrically charge the member to be charged.

4. A charging device comprising:

a charging member for charging a member to be charged;

a foamed layer;

a supporting member, for supporting said foamed layer, and for being supplied with an oscillating voltage;

a resistance layer closer to the member to be charged than said foamed layer;

wherein said foamed layer has a specific gravity not less than 0.1 (g/cm$^3$) and not more than 0.6 (g/cm$^3$), and wherein an average outer diameter of pores in a cross-section of said foamed layer is not less than 50 microns and not more than 1 mm.

5. A charging member according to claim 4, wherein said charging member comprises an electroconductive layer between said foamed layer and said resistance layer.

6. A charging member according to claim 4, wherein said charging member is contactable to the member to be charged to electrically charge the member to be charged.

7. A charging member according to claim 4, wherein said oscillating voltage has a frequency higher than 300 Hz.

8. A charging member according claim 4, wherein a peak-to-peak voltage of the oscillating voltage is not less than twice a charge starting voltage of the member to be charged.

9. A process cartridge detachably mountable to an image forming apparatus comprising:

an image bearing member;

a charging member for charging a member to be charged, including a foamed layer;

a supporting member, for supporting said foamed layer, and for being supplied with an oscillating voltage;

a resistance layer closer to the member to be charged than said foamed layer;

wherein said foamed layer has a specific gravity not less than 0.1 ($g/cm^3$) and not more than 0.6 ($g/cm^3$), and wherein an average outer diameter of pores in a cross-section of said foamed layer is not less than 50 microns and not more than 1 mm.

10. An apparatus according to claim 9, wherein said process cartridge comprises developing means for developing the image bearing member.

11. A process cartridge according to claim 9, wherein said image bearing member is an electrophotographic photosensitive member.

12. An image forming apparatus comprising:

an image bearing member;

a charging member for charging a member to be charged, including a foamed layer;

a supporting member, for supporting said foamed layer, and for being supplied with an oscillating voltage;

a resistance layer closer to the member to be charged than said foamed layer;

wherein said foamed layer has a specific gravity not less than 0.1 ($g/cm^3$) and not more than 0.6 ($g/cm^3$), and wherein an average outer diameter of pores in a cross-section of said foamed layer is not less than 50 microns and not more than 1 mm.

13. A process cartridge according to claim 12, wherein said image bearing member is an electrophotographic photosensitive member.

* * * * *

UNITED STATES PATENT AND TRADEMARK OFFICE

CERTIFICATE OF CORRECTION

PATENT NO. : 5,543,899 Page 1 of 2

DATED : August 6, 1996

INVENTOR(S) : SATORU INAMI, ET AL.

It is certified that error appears in the above-indentified patent and that said Letters Patent is hereby corrected as shown below:

COLUMN 2:

Line 7, "are disappeared." should read --disappear.--.

COLUMN 5:

Line 7, "member," should read --member will be described,--.

COLUMN 6:

Line 2, "his," should read --this,--;
Line 13, "w($cm^3$) is deter-" should read --w($cm^3$).--;
Line 14, "mined." should be deleted;
Line 56, "2b" should read --2b is--; and
Line 62, "0.5 g/$cm^3$." should read --0.6 g/$cm^3$.--.

COLUMN 7:

Line 49, "an din" should read --and in--.

COLUMN 8:

Line 64, "degree" should read --degrees--.

COLUMN 12:

Line 14, "by which" should be deleted;
Line 31, "charged" should read --charged,--;
Line 33, "supporting member," should read --a supporting member,--;

UNITED STATES PATENT AND TRADEMARK OFFICE

CERTIFICATE OF CORRECTION

PATENT NO. : 5,543,899 Page 2 of 2

DATED : August 6, 1996

INVENTOR(S) : SATORU INAMI, ET AL.

It is certified that error appears in the above-indentified patent and that said Letters Patent is hereby corrected as shown below:

Line 34, "voltage;" should read --voltage; and--;
Line 53, "voltage;" should read --voltage; and--;
Line 62, "member" should read --device--; and
Line 65, "member" should read --device--.

COLUMN 13:

Line 1, "member" should read --device--;
Line 3, "member" should read --device--;
Line 13, "voltage;" should read --voltage; and--; and
Line 22, "An apparatus" should read --A process cartridge--.

COLUMN 14:

Line 10, "voltage;" should read --voltage; and--; and
Line 20, "A process cartridge" should read --An apparatus--.

Signed and Sealed this

Eighteenth Day of March, 1997

Bruce Lehman

*Attest:*

BRUCE LEHMAN

*Attesting Officer*

*Commissioner of Patents and Trademarks*